US008444832B2

(12) United States Patent
Gutekunst

(10) Patent No.: US 8,444,832 B2
(45) Date of Patent: May 21, 2013

(54) APPARATUS AND METHOD FOR PROVIDING ELECTRICAL CONTACT FOR PLANAR MATERIAL IN STRAIGHT THROUGH INSTALLATIONS

(75) Inventor: Mathias Gutekunst, Haiterbach (DE)

(73) Assignee: Rena GmbH, Gutenbach (DE)

( * ) Notice: Subject to any disclaimer, the term of this patent is extended or adjusted under 35 U.S.C. 154(b) by 582 days.

(21) Appl. No.: 12/670,026

(22) PCT Filed: May 8, 2009

(86) PCT No.: PCT/EP2009/003298

§ 371 (c)(1),
(2), (4) Date: Jan. 21, 2010

(87) PCT Pub. No.: WO2009/146773

PCT Pub. Date: Dec. 10, 2009

(65) Prior Publication Data

US 2010/0187068 A1 Jul. 29, 2010

(30) Foreign Application Priority Data

May 30, 2008 (DE) ..... 10 2008 026 199

(51) Int. Cl.
*C25D 17/06* (2006.01)
*C25D 17/28* (2006.01)

(52) U.S. Cl.
USPC ..... 204/206; 204/198; 204/199; 204/224 R; 118/426; 118/429

(58) Field of Classification Search
USPC ..... 204/198, 199, 206, 224 R; 118/426, 118/429
See application file for complete search history.

(56) References Cited

U.S. PATENT DOCUMENTS 4,102,772 A * 7/1978 Nakamura et al. ..... 204/206
4,267,024 A * 5/1981 Weiskopf ..... 205/130
4,364,328 A * 12/1982 Fukuda et al. ..... 118/411
4,419,194 A * 12/1983 Angelini ..... 205/142

(Continued)

FOREIGN PATENT DOCUMENTS

DE 00008812212 U1 1/1989
DE 000069000361 T2 9/1992

(Continued)

*Primary Examiner* — Bruce Bell
(74) *Attorney, Agent, or Firm* — Biotech Beach Law Group PC

(57) ABSTRACT

The invention relates to the electrical contacting of planar goods 1 in the form of segments in in-line plants for the electrolytic and/or wet chemical treatment of the treatment side 10 of the good by applying electrical external current while keeping the upper contacting side 9 dry and dipping the treatment side 10 into the treatment liquid 11.

By use of the known transport systems having upper and lower transport and/or contact means, treatment liquid 11 is transferred from the lower means to the upper ones so that the top side of the good is often inadmissibly wetted and the upper contacts are electroplated, therefore needing to be continuously de-metallized, thus requiring a larger effort.

According to the invention, the level is lowered in the region of upper contacts 6. Therefore, the same cannot be wetted, even when no good is present in the region of the contacts 6. This is achieved by means of down pipes 5 which are assigned to each contact 6. Even when in the relaxed state, the contacts do touch no treatment liquid, so that the top side of the good stays dry and the contacts do not require a de-metallization.

17 Claims, 3 Drawing Sheets

U.S. PATENT DOCUMENTS

| | | | | |
|---|---|---|---|---|
| 7,125,477 | B2 * | 10/2006 | Butterfield et al. | 204/224 M |
| 2003/0054110 | A1 * | 3/2003 | Yamaguchi et al. | 427/420 |
| 2006/0196414 | A1 * | 9/2006 | Schuhmacher et al. | 118/50 |
| 2008/0241378 | A1 * | 10/2008 | Kappler | 427/248.1 |
| 2009/0032492 | A1 * | 2/2009 | Kunze-Concewitz | 216/13 |

FOREIGN PATENT DOCUMENTS

| | | | |
|---|---|---|---|
| DE | 103 13 127 | B4 | 10/2006 |
| DE | 10 2005 038 449 | A1 | 2/2007 |
| DE | 10 2005 039 100 | A1 | 2/2007 |
| EP | 0 992 617 | A2 | 4/2000 |
| EP | 2 060 659 | A | 5/2009 |
| WO | WO 90/02219 | A | 3/1990 |
| WO | WO 2005/093788 | | 10/2005 |

* cited by examiner

APPARATUS AND METHOD FOR PROVIDING ELECTRICAL CONTACT FOR PLANAR MATERIAL IN STRAIGHT THROUGH INSTALLATIONS

This application is a 371 of PCT/EP2009/003298 filed on May 8, 2009.

This application is a national phase application in the United States of America of PCT international patent application serial no. PCT/EP2009003298, filed on May 8, 2009, which claims priority to Germany patent application serial no. 10 2008 026 199.8, filed on May 30, 2008; the contents of each are incorporated herein by reference in their entirety.

The invention relates to the transport or the conveyance and to the electrical contacting of planar good in electrolytic or wet chemical in-line plants. The good relates to e.g. wafers, solar cells made of silicon, circuit boards, or hybrids, which have to be treated single-sidedly only in at least one process by applying an external current, e.g. electrolytically. Herewith the side of the good which must not be treated should not be wetted or contaminated by the treatment liquid. Even the slightest traces of wettings must be avoided in order to circumvent the good from being rejected.

The documents DE 10 2005 038 449 A1 and EP 0 992 617 A2 show widely used in-line plants with typical driven conveying means, such as rollers with rings and shafts with rolls and small wheels.

Due to the arrangements of the conveying means within these in-line plants, the top side as well as the underside of the good is wetted with the treatment liquid as intended. If only the underside of the good should or can be wetted, a significantly larger technical effort is necessary, at least in the case of an electrolytic treatment of the good. In this case, the treatment liquid only reaches up to the underside of the mostly thin good. A contact force must be exerted onto the flat good from at least one side in order to achieve secure electrical contacting. Such an electroplating apparatus is described in the document DE 10 2005 039 100 A1. The top sides of the goods, i.e. substrates such as solar cells, are protected in a frame by means of seals against entry of the treatment liquid which reaches up to the underside of the goods. Very soft pressure rolls press the solar cells against the contacts of the frame projections for electrical contacting. The frame serves as a receptacle for several solar cells.

In both firstly mentioned documents, the transport means or the contact means, respectively, roll along the top side and the underside of the good. The transport means only serve the purpose of transporting the good. The contact means serve the purpose of transporting and electrical contacting of the good, or only its contacting.

Even if the level of the treatment liquid and the level of the transport track are adjusted in such a way that only the underside of the good is wetted, the top side remains at least partially not dry according to the state of the art, because the good is conveyed, through the in-line plant, in the form of segments such as solar cells, parallel to each other and one after the other. A circumferential free space of approximately 10 to 30 mm is present between each good. This space is subsequently referred to as a lateral gap, perpendicular to the transport direction or to the conveying direction, respectively. The lower rotating conveying means are entirely immersed in the treatment liquid and wetted by it. Opposite to these conveying means, further conveying means are arranged on the top side of the good. They roll along the initially dry top side of the good. A lateral gap follows each segment of good. The upper, still dry conveying means rolls into this gap, onto the lower, wet conveying means for a short period of time. In particular if the good is very thin and/or if this lateral gap has the mentioned length. Herewith, the upper conveying means picks up treatment liquid from the lower conveying means. This treatment liquid is then transferred onto the surface of the top side of the following good.

An in-line plant consists, in the conveying direction, of e.g. 100 or more rotating transport shafts which are briefly referred to as shafts in the following. These extend perpendicular to the transport direction along the entire transport track. A multitude of conveying means are arranged on the shafts according to the width of the conveying tracks. Due to the large number of shafts, the effect of transferring the treatment liquid from the lower conveying means to the top side of the good is repeated 100 times or more. The good is thereby wetted by the conveying means on its top side, even if the level of the treatment liquid does not reach up to the top side. At least in the region of the transport tracks.

In order to keep the top side of the good, which must not be wetted, dry in the course of a single-sided spray treatment, the use of a protective cover is proposed, according to document DE 690 00 361 T1, for the top side. However, this type of solution is unsuitable in the case of the present wet treatment, since particularly in the border regions undesired liquid would also reach the top side of the good through the capillary gap, which cannot be avoided without sealing means. Upon additional use of sealing means, these would have to be pressed against the top side of the good with a relatively high surface pressure, which in turn could lead to damage or even breakage of the good. Such sealing means are disclosed in document DE 88 12 212 U1, whereby the sealing means already engage with the underside of the good to be treated, thus avoiding an etchant from passing onto the top side which must be kept dry. However, an arrangement of sealing means on the underside naturally allows for only an incomplete treatment of the same, which is presently undesired.

The documents DE 103 13 127 B4 and WO 2005/093788 respectively describe wet chemical etching techniques for substrates which can be carried out in in-line plants where the liquid level is adjusted so that only the underside of the substrates, including the edges, is wetted. The top side is not wetted in this case since the planar good is solely positioned on lower conveying means. However, this method for keeping the top side of the good dry is not intended for the electrolytic treatment of good. Possible electrical contacting of the cathodic underside, i.e. of the side that should be electroplated in the electrolyte, requires a continuous anodic de-metallization of the contact means in this electrolyte here. This is impossible e.g. for the precious metals which are used in practice. These precious metals do not anodically dissolve in the given electrolyte. Therefore no de-metallization of the electroplated contacts is possible in this way. This is why an attempt is made to electrically contact a top side which must not be electroplated but kept dry from this side, i.e. from outside the electrolyte. However, these known upper contact means are wetted in the described lateral gaps between two goods which follow each other. Because they are cathodically poled, they are also particularly intensely electroplated in the region of the lateral gaps, which should be avoided.

SUMMARY OF THE INVENTION

It is the object of the invention to enable the horizontal conveyance of good in in-line plants which is to be treated wet chemically or electrolytically only on one, namely its underside, by applying an external current, wherein contact means are in contact with the good at the top side of the good and along the transport track, and wherein the treatment liquid that only reaches up to the underside of the planar good is not transferred onto the dry top side.

The problem is solved by the apparatus according to claim 1 and by the method according to claim 13. The subclaims describe advantageous embodiments of the invention. The methods for the treatment of e.g. wafers, solar cells, or hybrids relate particularly to the electroplating, the electrolytic etching, and the electrolytic polishing. The invention is also suited for further wet processes such as e.g. doping, activating, passivating, texturing and chemical etching, if an acceleration or improvement of the process can be achieved for this by an external current. Such processes exist in conjunction with goods that are produced in very large quantities. For this, the in-line plants are manufactured for the production of a good that always remains constant in, at least, its dimensions.

In the following, the invention is merely described using the example of electroplating and the therefore necessary anodes. However, it is also true for the other processes upon application of external current. For this, the required counter-electrodes can be anodic or cathodic, and the contacts as well as the good can be cathodic or anodic.

The invention is described using the example of solar cells with the widely used dimensions 156×156 $mm^2$. However, it is also valid without limitation for other planar good which must be treated in the form of segments in in-line plants.

The treatment of solar cells represents a very special technical challenge. The thickness of these silicon plates amounts to e.g. 140 μm or less. They are therefore very fragile. The surface of the top side which must be kept dry during the wet treatment would often react very heavily with the treatment liquids, i.e. it must be securely protected against a wetting. This means that also upper conveying means and/or contact means must not be wetted by the lower conveying means or further construction means in the lateral gaps described above. The same is true for other products in the form of segments which must be treated with a dry top side.

In an in-line plant, several identical goods, e.g. solar cells, are usually loaded in parallel, i.e. side by side, and fed in one after another. The shafts which are arranged perpendicular to the transport direction contain an according number of conveying tracks, e.g. 8, with the required transport means and/or contact means on each shaft. The conveying tracks are subsequently indicated by capital letters, i.e. A to H for 8 conveying tracks. Each shaft is arranged in transport direction in a position of the in-line plant which shall be indicated by digits here, e.g. position pos. 1 for the first shaft of the in-line plant.

The invention provides only conveying means on the underside whose longitudinal and lateral distances depend on the dimensions of the good. The invention provides contact means on the top side that can effect as conveying means at the same time as well. The number of these means is preferably different on the both sides of the good. The level of the electrolyte reaches up to the underside of the good so that this side can be wet treated. The level of the electrolyte is lowered according to the invention at least to such an extent at the locations where the upper contact means and/or upper conveying means are arranged, so that these contact—and/or conveying means cannot be wetted, even when there is no good present in front of the contact or the conveying means. Locally restricted acting overflows serve for the lowering of the level.

For conveyance, the good is carried and conveyed in conveying direction at least by the conveying means that are arranged on the lower shafts. The conveying means can be designed as transport wheels, transport rings, transport discs on rotating shafts. The distance a of the shafts or rollers in conveying direction is usually independent of the dimensions of the good and the lateral gap. It particularly depends on the length of the good. At least two shafts with conveying means should always be engaged with the good in conveying direction in order to ensure a secure conveyance.

BRIEF DESCRIPTION OF THE DRAWINGS

The invention is subsequently being further described on the basis of the schematic and not to scale FIGS. 1 to 3.

DETAILED DESCRIPTION OF THE INVENTION

Figure 1:
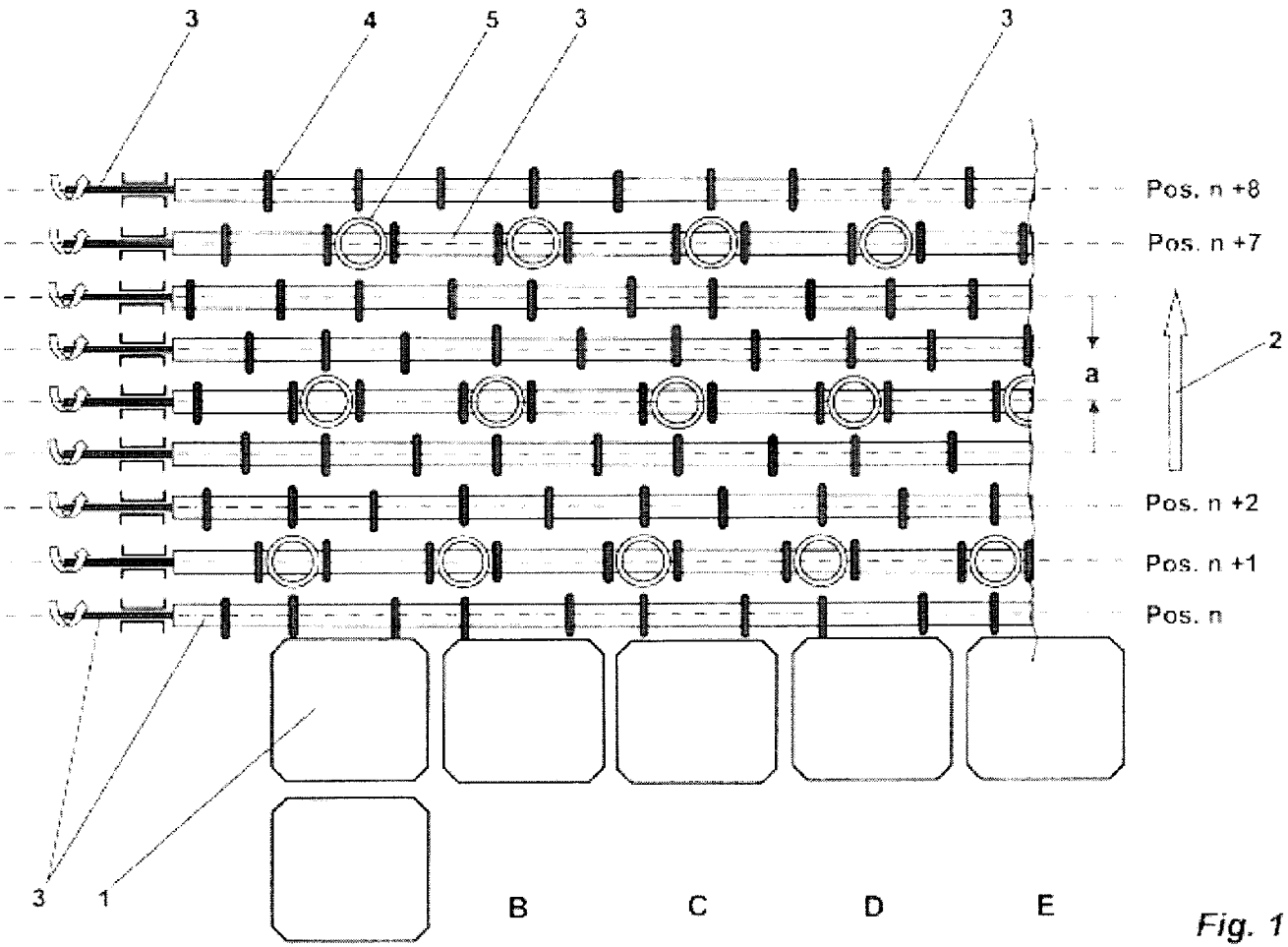
FIG. 1 shows the arrangement of the conveying means and the overflows in the working tank as a detail in a top view.

In FIG. 1, the good 1 is conveyed in direction of the transport direction arrow 2. For this, rotationally driven shafts 3 serve as conveying means. As depicted, these shafts 3 can be equipped with rings 4 which lead to in the final outer diameter of the conveying means. The good 1 rests on the rings 4 which rotate together with the shaft 3. It is pulled against the rings 4 not least because of the later described suction that occurs in the overflow pipe 5, as a result of which a directionally stable transport of the good 1 takes place. Small wheel shafts or rollers suit as conveying means as well. The rollers mainly provide the accordingly dimensioned outer diameter. At least one contact means can be assigned to each conveying means 3 in the region of each conveying track A, B, C, etc. In FIG. 1, a contact means which is not shown is provided after each third conveying means 3. According to the invention, the level of the electrolyte is lowered to such an extent in the region of this contact means so that even a contact which is not engaged with the good is not wetted. This is achieved by overflows for the electrolyte which are locally restricted arranged in the working tank. Overflow pipes 5 or down pipes serve for the local lowering of the level in the example of FIG. 1. At the top, these overflows reach close to the plane of the underside of the goods 1, as a result of which the transport of the goods is not hindered. Thus, the overflow edge of the overflow pipes 5 lies slightly below the common level of the treatment liquid of the working tank. The amount of the overflowing treatment liquid can be adjusted for each overflow by this height difference. The other end of the overflow pipe 5 ends in the lower tank which is separated from the working tank and serves as a receiver tank and pump sump.

The number of contact means in transport direction is chosen so large that always at least one contact is engaged with each respective good 1. The overflows, and thus the contacts on the contact means with them, as well as the rings 4 on the shafts 3, are arranged perpendicular to the transport direction, and, for the avoidance of track formations, preferably accordingly offset from position to position.

Figure 2:
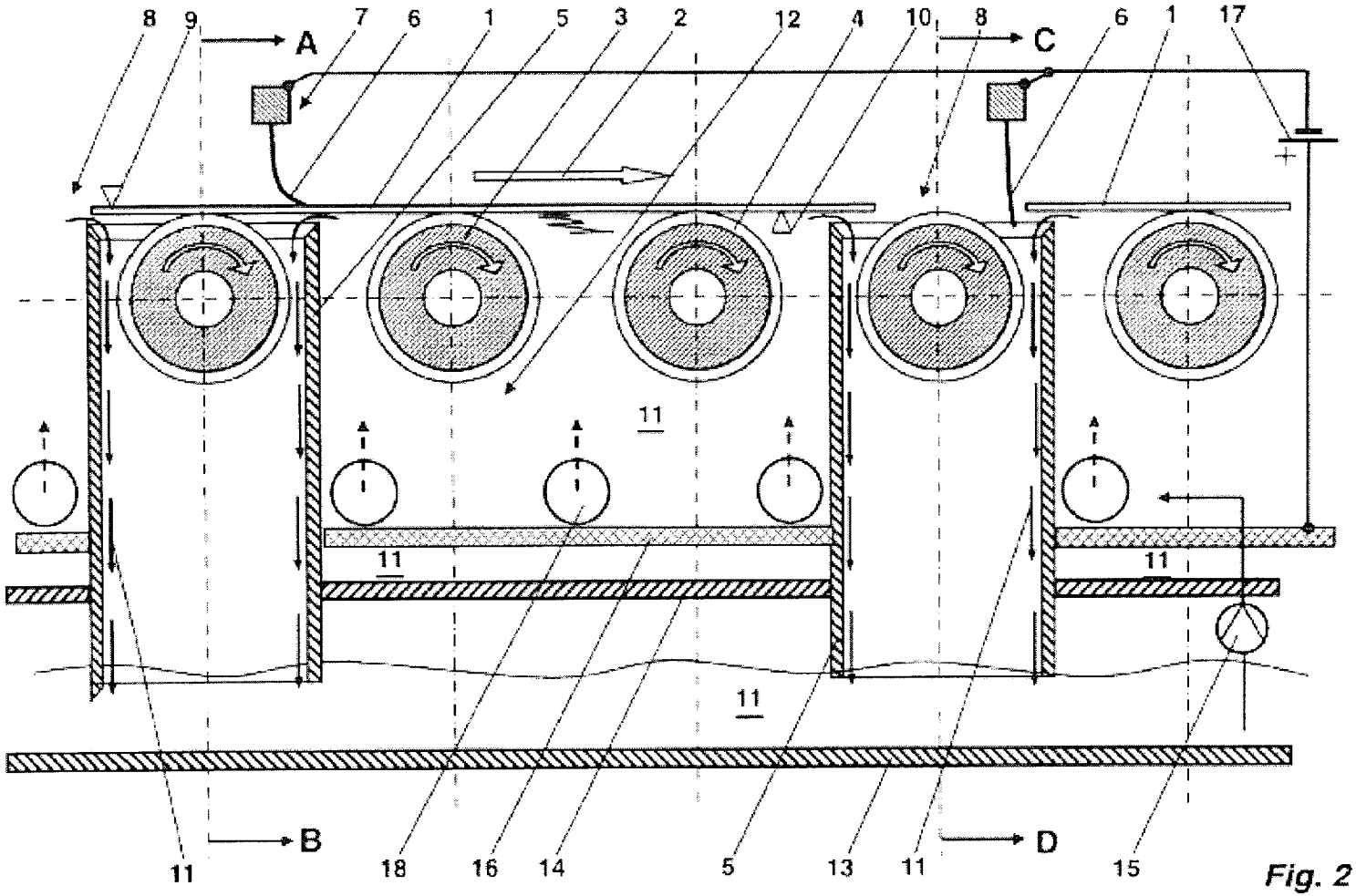
FIG. 2 shows an in-line plant for the electrolytic treatment of solar cells in a side view.

FIG. 2 shows the contacts 6 which are located at stationary arranged contact means 7. The contacts 6 are sliding contacts which slide along the electrically conductive top side 9 of the good 1, thus transferring the electrical current which is necessary for the electrolytic treatment to the good 1. The contacts 6 consist of e.g. electrically conductive fine wiry strands or thin elastic bands. Instead of the sliding contacts 6, rotating contacts can be used as well. These are arranged on rotationally driven shafts at the top side 9 of the good 1 in the region of the respective contact tracks and the overflows. The actual contact means of the contact wheel are e.g. also electrically conductive fine wiry strands or thin elastic bands. The contacts roll along the top side 9 of the good 1. They then support the transport of the same, thus allowing to achieve a larger contact force. This is particularly advantageous if a good must be treated at its full underside with a high current density. In this case, a larger current must be transferred over each rotating contact, e.g. 10 Amperes.

This current reaches from the top side 9 through the good to underside 10 which is the actual treatment side. By this way of electrical contacting it is achieved that the cathodic contacts 6 are very advantageously not electroplated. A de-metallization of the contacts that would, according to experience, require a very large technical effort, is therefore also not necessary.

The contacts 6 must not come in contact with the electrolyte for a secure avoidance of de-metallization of the contacts. An overflow is provided for this purpose, which is depicted as overflow pipe 5 here. The electrolyte 11 laminarly flows separated from the liquid which is present in the working tank 12, along the inner wall of the overflow pipe 5, through the bottom 14 of the working tank 12, into the lower tank 13 which serves as receiver tank and, simultaneously, as pump tank.

The electrolyte 11 gets, by means of at least one pump 15, from the lower tank 13 back into the working tank 12, so that the electrolyte circuit is being closed.

The contacts 6 that are attached to the contact means 7 slide over the top side 9 of the good 1, mechanically transferring current under pre-tension. This situation is depicted left-hand. The sliding or rotating contact relaxes and stretches in the region of a lateral gap 8 and plunges below the plane of the bottom side 10 of the good 1. In doing so, it neither touches the wetted inner wall of the overflow pipe 5 nor the shaft 3 of the conveying means, respectively, which can be wetted by the electrolyte as well. This situation is depicted at the right overflow.

Elongated overflows can be arranged instead of the overflow pipes 5 in the region of the contact means. An example for this is an overflow gutter perpendicular to the transport direction.

The shafts 3 bearingly penetrate the overflow pipes 5. This allows for the very precise adjustment of the level of the good from its underside 10 to the height of the opening of the overflow pipes 5 at this side. Therefore, temperature related changes of the dimensions of the construction elements have, even in very large in-line plants, no influence on the distance, which is necessary for the overflow, between good and overflow pipe.

At least one soluble or insoluble anode 16 is arranged in the working tank 12 inside the electrolyte 11 for the formation of the electrolytic cell. This anode 16 which is commonly also referred to as counter electrode is electrically connected to at least one plating current source 17 or generally to a current source. Thus, the electrical plating current circuit closes itself over the contact means 7, the contacts 6, the good 1, the electrolyte 11 in working tank 12, and the anode 16. Prerequisite for this circuit is that the good is electrically conductive from the top side 9 to the bottom side 10. This is the case e.g. for a metallic substrate. A solar cell, made from silicon, which shall be electroplated on the sun side is firstly not electrically conductive upon the given polarity. The solar cell becomes generatively low-resistive not until the sun side is being sufficiently illuminated, thus being able to pass through the plating current. Light is introduced into the electrolytic cell for this application. This takes place by means of light sources 18 which are preferably arranged between the conveying means perpendicular to the transport direction.

Figure 3A:
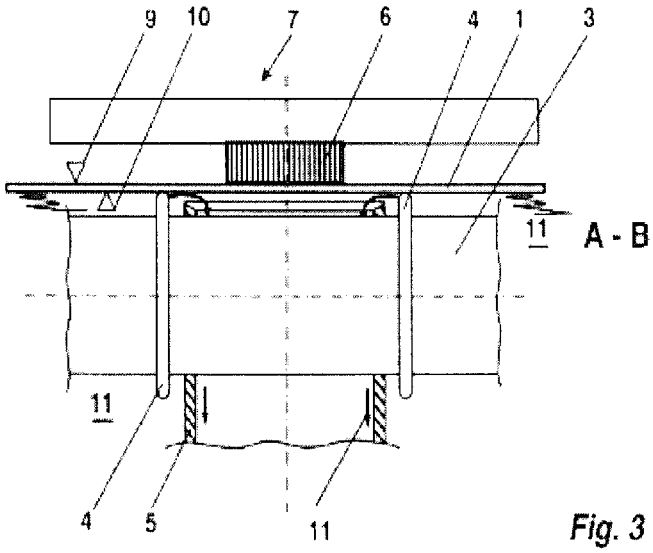
FIG. 3*a* shows the situation of a contact during the electrical contacting when viewed in transport direction.

FIG. 3 a shows the cut view A-B of FIG. 2. The elastically pre-tensioned contact 6 rests electrically contacting on the top side 9 of the good 1. In general, the electrical current that must be contacted is small, e.g. 1 Ampere, because the surface which must be electrolytically treated is also small for the sun side of a solar cell. Therefore, only a small contact force is necessary as well. Experiments have shown that this contact force of the sliding contacts has no influence on the transport of the good. Even when the contacts slide over the good 1, the transport occurs directionally stable, although upper conveying means are completely omitted. Fine wiry strands from copper, stainless steel or precious metal, which are arranged next to each other in the form of a fan of e.g. 10 mm width, are suitable as elastic contacts 6. A wide elastic band made of an electrically conductive material that slides over the top side of the good similar to a spatula is also very well suitable as contact 6.

Figure 3B:
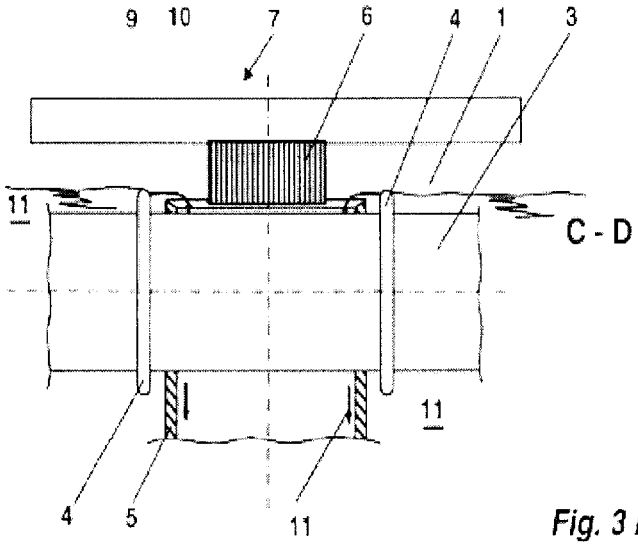
FIG. 3*b* shows this situation in the region of the contact during a lateral gap.

FIG. 3*b* shows the cut view C-D of FIG. 2. Here, the contact means 7, and therefore the contact 6, are momentarily located in the region of a lateral gap 8 between two goods 1. The elastic contact 6 is relaxed. The contact is not wetted although it can be arranged with its lower edge below the common level of the electrolyte present in the working tank. The cathodically poled contact 6 is kept free by the overflow 5. It is therefore not electroplated as well.

A continuous exchange of electrolyte takes also place at the underside 10 to be treated of the good 1 by means of the permanently overflowing electrolyte. In the course of an electrolytic treatment, this allows the application of suitably dimensioned current densities, e.g. of 10 $A/dm^2$ in an acidic copper bath. Thus, by means of the overflows designed according to the invention, not only a dry electrical contacting is achieved that does not require a de-metallization of the contacts, but advantageous hydrodynamic conditions are simultaneously realized at the good's underside which is to be treated.

LIST OF REFERENCES

1 good
2 transport direction arrow
3 shaft, conveying means
4 ring, O-ring
5 overflow, down pipe
6 contact
7 contact means
8 lateral gap
9 top side of the good, contacting side
10 bottom side of the good, treatment side
11 electrolyte, treatment liquid
12 working tank
13 lower tank
14 bottom
15 pump
16 anode, counter electrode
17 plating current source, current source
18 light source

What is claimed is:

1. Apparatus for the horizontal conveyance and for the electrolytic and/or electrically assisted wet chemical treatment of goods (1), comprising:

a working tank (12) having wetting regions for providing a higher level of treatment liquid and a plurality of lower rotating conveying means (3) that are horizontally arranged and perpendicular to a transport direction (2) in such a manner that an underside side (10) of the goods (1) can be transported through the treatment liquid (11) while a top side (9) of the goods (1) remains dry, overflow regions in the form of down pipes (5) for providing a lower level of the treatment liquid (11) compared to the wetting regions, and a bottom (14);

a plurality of contacts (6) configured to electrically contact the top side of the goods (1) during the transportation of the underside (10) through the treatment liquid (11), wherein contacts (6) in the overflow regions are arranged above the down pipes (5); and a lower tank (13) for receiving the treatment liquid (11) from the down pipes (5) through the bottom (14) of the working tank (12).

2. Apparatus according to claim 1, characterized in that the down pipes (5) have upper ends with overflow edges that only reach the underside (10) of the good to be treated to such an extent that the transport of the good is not hindered, and lower ends that reach through the bottom (14) of the working tank (12) and lead into a lower tank (13).

3. Apparatus according to claim 1, characterized in that the level of the treatment liquid in the wetting regions of the working tank (12) is higher than overflow edges of the down pipes (5).

4. Apparatus according to claim 1, characterized in that the contacts (6) are sliding or rotating contacts, wherein the contacts do not, in a region of a lateral gap (8) between goods (1), contact the treatment liquid or wetted surfaces, even in a relaxed state.

5. Apparatus according to claim 1, characterized in that the contacts consist of fine wiry strand, or of a soft flexible band.

6. Apparatus according to claim 1, characterized in that the lower rotating conveying means (3) are, with respect to their height level, beared onto or in the down pipes (5).

7. Apparatus according to claim 1, characterized in that the conveying means (3) are equipped with rings (4) which are each arranged offset along a transport track from position to position and perpendicular to the transport direction.

8. Apparatus according to claim 1, characterized in that at least one contact (6) is assigned to each down pipe (5).

9. Apparatus according to claim 1, characterized in that light sources (18) for the irradiation of goods being solar cells are arranged in the working tank (12).

10. Apparatus according to claim 1, characterized in that soluble or insoluble anodes (16) for electroplating are arranged in the working tank (12).

11. Apparatus according to claim 1, characterized in that counter electrodes being fed by a current source are arranged in the working tank (12) for influencing the process.

12. Method for the horizontal conveyance and for the electrolytic and/or electrically assisted wet chemical treatment of goods (1), comprising:

providing the apparatus as defined in claim 1, characterized in that the level of the treatment liquid (11) is adjusted by means of the down pipes (5) to be lower in regions of the upper contacting of the goods than the remaining level in the working tank (12), whereby the contacts, which are optionally sliding or rolling contacts, are not wetted by the treatment liquid (11), even in a relaxed state when currently not electrically contacting any good;

applying electrical current to the contacts;

adding at least one good to the apparatus; and instructing conveyance of the at least one good.

13. Method according to claim 12, characterized in that a bearing of the conveying means (3) on the down pipes (5) always levels out momentary constructive changes of the distance from the underside (10) of the good (1) to an upper edge of the down pipe (5) and keeps this distance constant.

14. Method according to claim 12, characterized in that the goods (1) are drawn to the lower rotating conveying means (3, 4) by the treatment liquid (11) that flows from the working tank (12) over the down pipes (5) to assist the transportation.

15. Method according to claim 14, characterized in that a liquid exchange at the good's underside (10) to be treated takes place by the streaming out of the treatment liquid (11) from the working tank (12) over the down pipes (5).

16. Method according to claim 12, characterized in that for the treatment of the sun side of solar cells, the same are irradiated in the working tank (12) by means of at least one light source (18).

17. The method according to claim 12, wherein the wet chemical treatment is for the electroplating of solar cells.

* * * * *